United States Patent [19]

Ward

[11] Patent Number: 5,067,308

[45] Date of Patent: Nov. 26, 1991

[54] MECHANISM AND METHOD FOR SUPPORTING AND INDIVIDUAL DISPENSING OF NESTED CONTAINERS

[75] Inventor: Larry K. Ward, Kansas City, Mo.

[73] Assignee: Sealright Co., Inc., Mo.

[21] Appl. No.: 462,138

[22] Filed: Jan. 8, 1990

[51] Int. Cl.[5] ..... B65B 3/04

[52] U.S. Cl. ..... 53/471; 53/250; 53/282; 221/223; 221/298; 221/297; 414/995.6; 414/998.1

[58] Field of Search ..... 53/250, 282, 300, 329, 53/471, 473, 485; 414/795.6, 797.8, 798, 798.1; 221/221, 223, 297, 298

[56] References Cited

U.S. PATENT DOCUMENTS

| | | | |
|---|---|---|---|
| 3,220,445 | 11/1965 | Taisey | 53/282 |
| 3,584,431 | 6/1971 | Flavelle | 53/471 |
| 3,775,934 | 12/1973 | Smith | 53/471 |
| 3,932,978 | 1/1976 | Kinney | 53/471 |
| 3,965,656 | 6/1976 | Gerben | 53/282 |
| 4,436,222 | 3/1984 | Taylor et al. | 221/223 |
| 4,529,101 | 7/1985 | Orlowski | 221/223 X |
| 4,608,809 | 9/1986 | Francis et al. | 53/471 |
| 4,809,881 | 3/1989 | Becker | 414/795.6 X |
| 4,948,011 | 8/1990 | Mueller et al. | 414/795.6 X |

*Primary Examiner*—John Sipos
*Assistant Examiner*—Linda B. Johnson
*Attorney, Agent, or Firm*—Kokjer, Kircher, Bowman & Johnson

[57] ABSTRACT

A method and apparatus are provided for supporting and dispensing a nested stack of containers. First and second pairs of support plates are spaced apart and movable between supporting and released positions. The first pair of plates support the container stack by engaging an out-turned lip of the lowermost container. Release of the first pair of plates incrementally advances the container stack to engage the second pair of plates. The second pair of plates are released to free the lowermost container after the first pair of plates are returned to the supporting position. A pair of thrusting fingers exert a downward force on the released container to deliver it to an awaiting transport receptacle at the desired moment.

21 Claims, 3 Drawing Sheets

MECHANISM AND METHOD FOR SUPPORTING AND INDIVIDUAL DISPENSING OF NESTED CONTAINERS

BACKGROUND OF THE INVENTION

This invention relates in general to container filling equipment and, more particularly, to a mechanism for holding a stack of nested containers and dispensing them one at a time for transport and filling. The invention also pertains to a method for holding and dispensing the containers for transport and filling during processing.

Many types of food products such as ice cream and other dairy items are packaged in containers which have a tapered sidewall. The containers are constructed with this configuration so that they may be packed and shipped in space-saving nested stacks. The nested container stack also provides a convenient method of loading the containers into a feed magazine or dispenser during filling operations. The feed magazine is positioned over a movable mechanism which transports the containers one-at-a-time to a filling station where the food or other product is introduced into the container. The filled container is subsequently sealed by application of a lid or other sealing device and further processed as needed..LS2

To achieve high speed filling and processing, the containers must be delivered reliably and at a high rate of speed from the magazine to a receptacle in a carrier plate for delivery to the fill station. Satisfactory performance, however, is difficult to achieve because the lowermost container must be perfectly positioned over the receiving receptacle and must be released from the magazine and arrive in the receptacle prior to cycling of the apparatus. Because the containers are not aerodynamically stable, they may tumble as they fall from the magazine, resulting in jamming of the apparatus and increased material losses and operational costs. Moreover, precise timing of the release of a container from the nested stack is difficult to accomplish because of frictional and vacuum forces holding the container to the stack. Failure to deliver the container to the waiting receptacle on time results in further material and operational losses.

Construction of a suitable feed magazine which provides rapid and accurate dispensing of containers is difficult because the magazine must support the container stack while at the same time releasing the lowermost container in the stack. To achieve higher delivery speeds and greater reliability, conventional magazines or feeders have utilized various elaborate mechanisms for accelerating the downward drop of the lowermost container. In one prior art device, an oscillating escapement engages the bottom cup in the magazine and pushes it downward from the supported remainder of the stack. Another feeder utilizes a vacuum cup assist to pull the released container downward from the stack while still another feeder utilizes a group of timed rotating feedscrews which engage the outwardly rolled rim of the container. The feedscrews both support the stack and accelerate the downward release of the container. The speed and reliability of each of these devices, however, is less than desired for use with many high-speed filling processes.

SUMMARY OF THE INVENTION

It is an object of this invention to provide a feed magazine with a mechanism for supporting a stack of nested containers and dispensing one container at a time with greater speed and reliability than conventional feed magazine dispensing devices so that greater container filling and processing speeds may be realized.

It is also an object of this invention to provide a method for dispensing individual containers from a nested stack with greater speed and reliability than afforded by conventional methods so that container filling operations may proceed at faster rates with fewer interruptions necessitated by improperly positioned containers.

It is another object of this invention to provide a feed magazine with a mechanism for supporting a stack of nested containers and providing a positive acceleration over that of gravity to individual containers as they are dispensed so that the container may be delivered to an awaiting receptacle with greater accuracy in positioning and timing, thereby reducing the number of interruptions in the filling operation caused by misaligned containers.

To accomplish these and other related objects of the invention, a dispensing mechanism is provided for supporting a nested container stack and repetitive dispensing of one container at a time from the stack. The mechanism comprises a first or upper support plate positioned on a frame for supporting the container stack. The upper support plate is movable from the supporting position to a released position which permits incremental downward movement of the container stack. A second or lower support plate is spaced from the upper support plate and is positioned for engaging the lowermost container in the stack and supporting the container stack when the stack moves downward after release from the upper support plate. The lower support plate is movable to a released position permitting release of the lowermost container from the lower support plate. A thrusting finger is also provided for imparting a downward force to the lowermost container when it is released from the lower support plate. A suitable control mechanism is also provided for closing the lower support plate while the upper support plate is in the released position to allow incremental advancement of the container stack. The control mechanism then closes the upper support plate, moves the lower support plate to the released position, and activates the thrusting finger to dispense the lowermost container. When operated in this manner, the dispenser provides reliable and high speed dispensing of individual containers from the nest container stack.

Also included within the invention is a process for supporting a nested container stack and dispensing individual containers from the stack. The process comprises the steps of:

(a) supporting a lowermost container in the nested container stack on a lower support plate which is movable between support and released positions;

(b) supporting the remainder of the nested container stack on an upper support plate which is movable between support and released positions;

(c) moving the lower support plate to the released position to release the lowermost container;

(d) dispensing the released container by activating a thrusting finger to exert a downward force on the released container;

(e) returning the lower support plate to the support position;

(f) moving the upper support plate to the released position to permit downward indexing of the container stack and then returning the upper support plate to the support position when the lowermost container remaining in the container stack descends into engagement with the lower supper plate; and (g) repeating steps (a) through (f) to dispense additional containers from the nested container stack.

BRIEF DESCRIPTION OF THE DRAWINGS

In the drawings in which like reference numerals are used to refer to like parts in the various views.

DESCRIPTION OF THE PREFERRED EMBODIMENT

Figure 1:
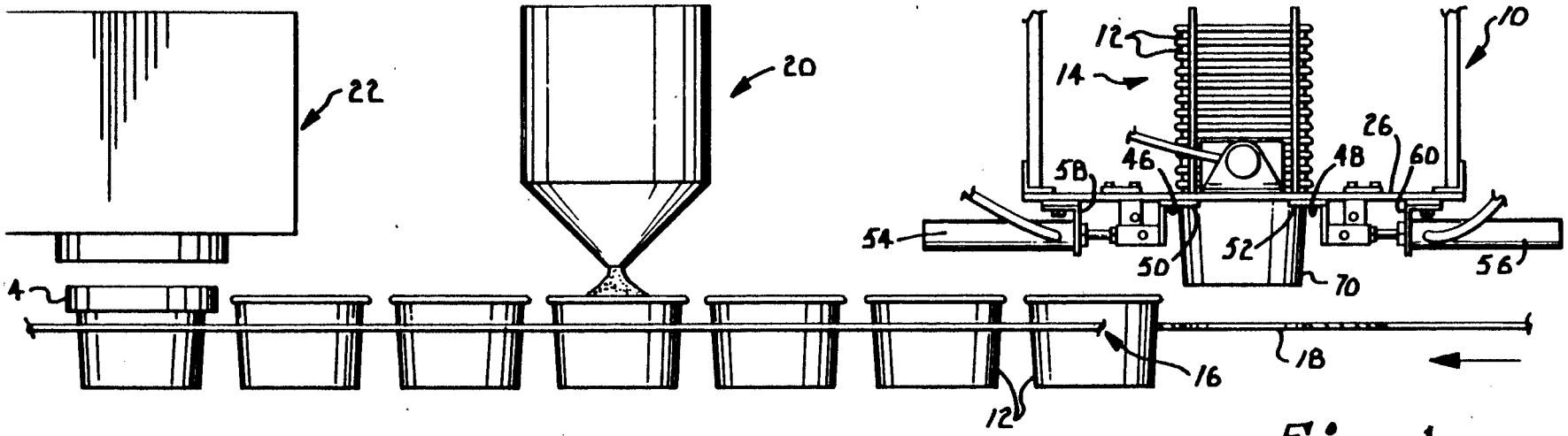
FIG. 1 is a somewhat schematic representation of a container dispensing, filling and sealing process of the present invention.

Referring now to the drawings in greater detail, and initially to FIG. 1, a container feed mechanism or dispenser of the present invention is represented generally by the numeral 10. Dispenser 10 is utilized to dispense individual containers 12 one at a time from a container stack 14 into one of a plurality of receptacles 16 formed in a carrier plate 18. Carrier plate 18 moves with an intermittent or continuous motion to advance the dispensed containers to a fill station 20 where a food product such as ice cream is introduced into the containers. Continued movement of the carrier plate 18 advances the filled containers to a seal station 22 where a lid 24 or other device is applied to each container to seal the contents.

Figure 3:
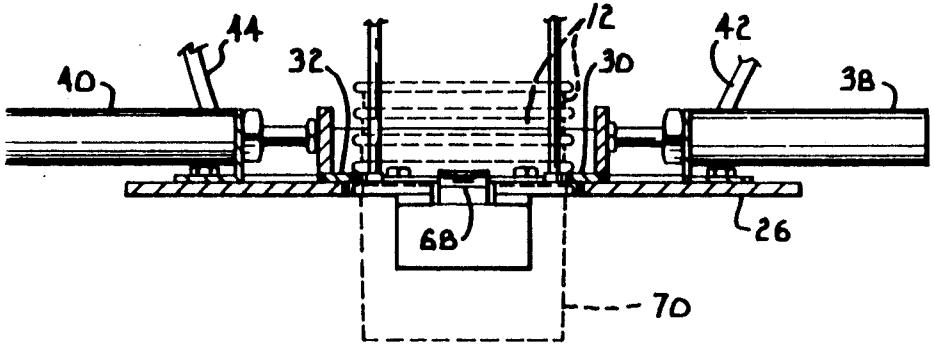
FIG. 3 is a side elevational view, taken along line 3—3 of FIG. 2, of a container dispenser of the present invention.
Figure 2:
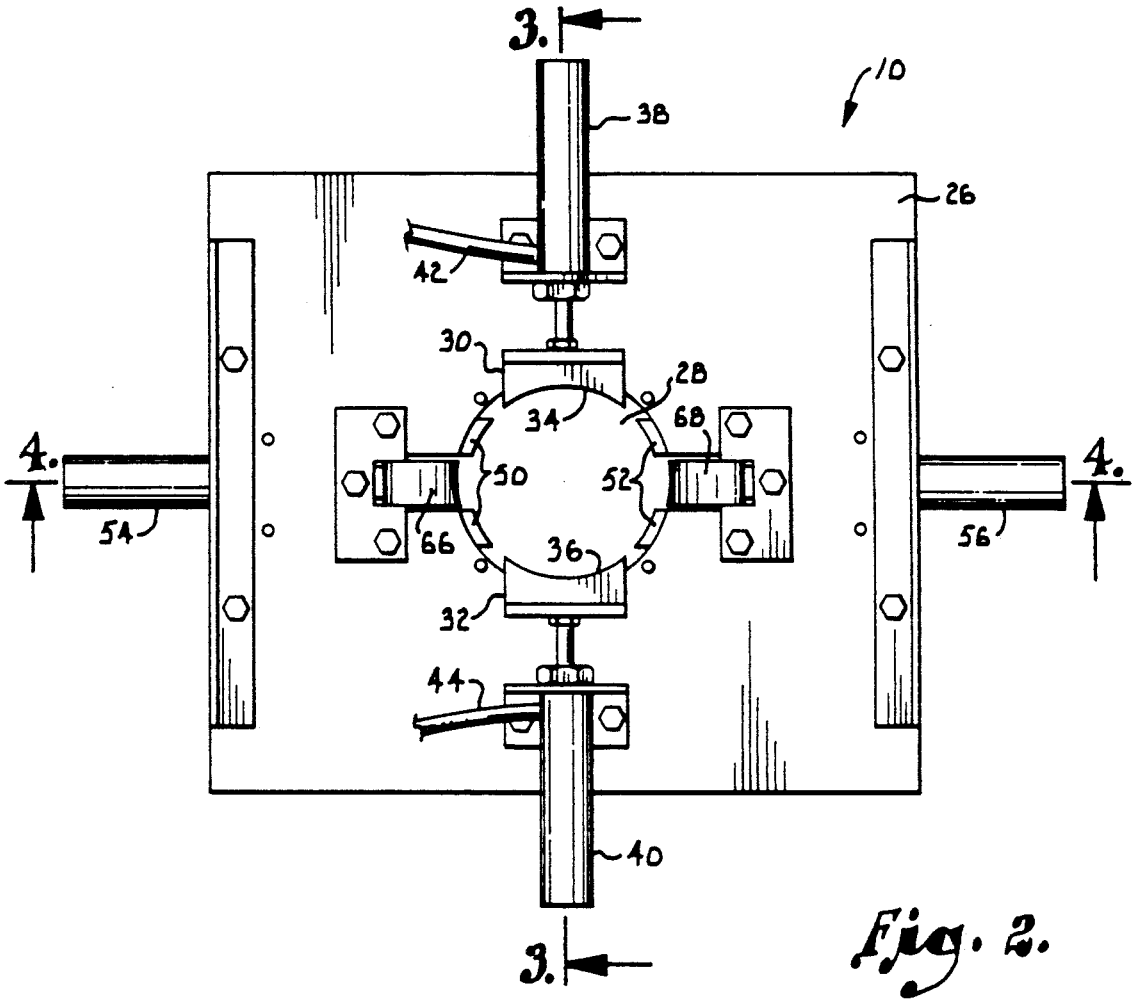
FIG. 2 is a top plan view of the container dispenser shown in FIG. 1.

Turning now to FIGS. 2–6 and, more particularly to FIG. 2, the dispenser 10 will now be described in more detail. A generally flat frame or platform 26 is provided with a central opening 28 which is sized slightly larger than the rolled rim diameter of the containers 12. A first pair of sliding support plates 30 and 32 are positioned on opposite sides of the opening 28. The plates 30 and 32 lie in a common plane slightly above the top surface of platform 26 and each has an arcuate leading edge 34 and 36, respectively, adapted for gripping the containers 12. The plates 30 and 32 are attached to suitable actuators 38 and 40 which move the plates between an activated position shown in FIG. 2 in which the leading edges 34 and 36 overlay the opening 28 and a recessed position in which the the leading edges are retracted and do not obstruct the opening. The actuators 38 and 40 are attached by connectors 42 and 44 to a suitable device which controls the actuators and causes them to operate in unison. As seen in FIG. 3, the plates 30 and 32 are in activated position and are gripping a container 12.

Figure 4:
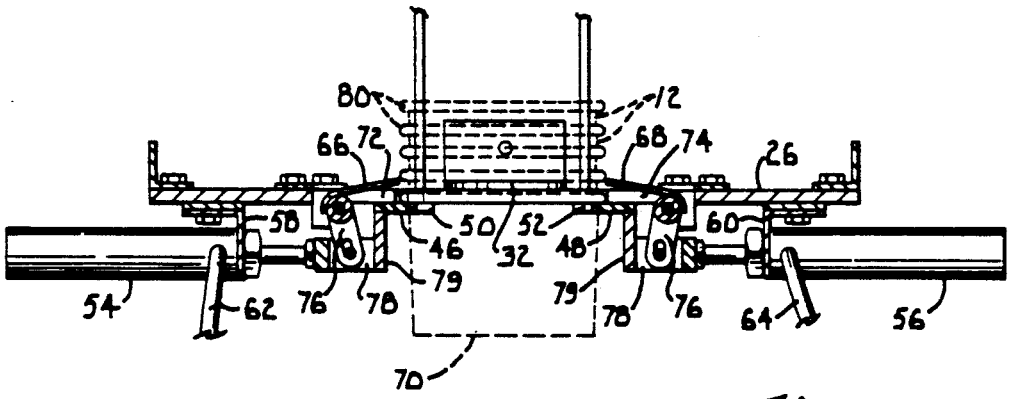
FIG. 4 is a side elevational view, taken along line 4—4 in FIG. 2, of a container dispenser of the present invention with a container stack loaded in the dispenser.
Figure 5:
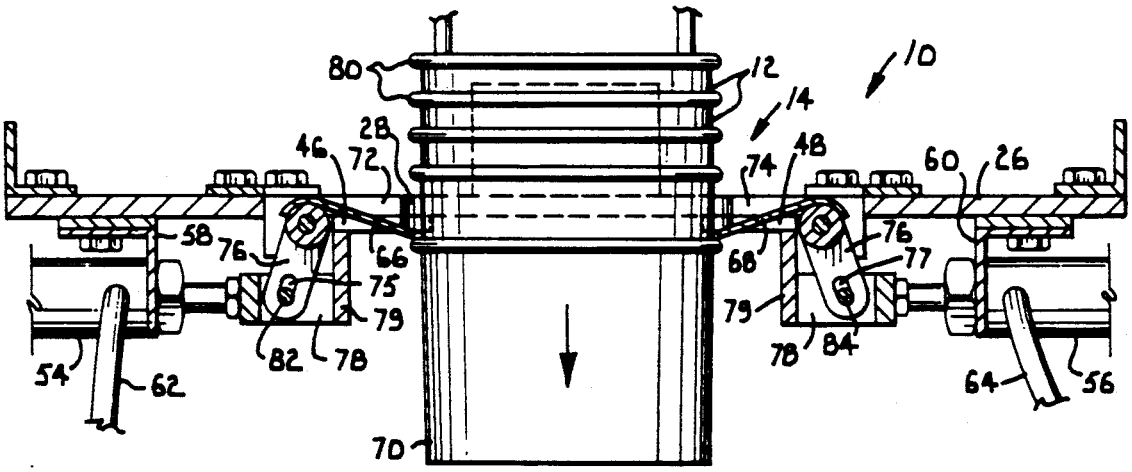
FIG. 5 is an exploded side elevational view, taken in vertical section, of the container dispenser of FIG. 4 and illustrating displacement of the lowermost container from the container stack.
Figure 6:
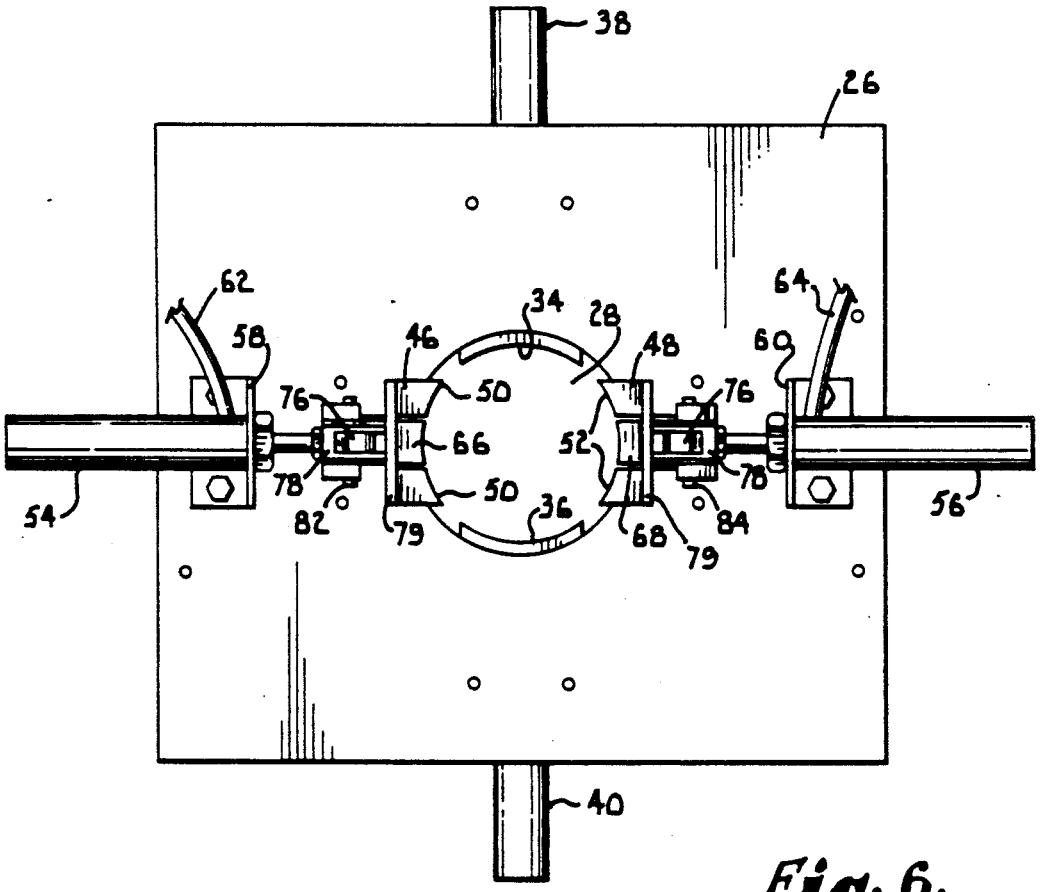
FIG. 6 is a bottom plan view of the container dispenser.

Turning additionally to FIGS. 4 and 5–6, a second pair of coplanar support plates 46 and 48 are positioned on the undersurface of platform 26 around opening 28. The second pair of support plates 46 and 48 have leading edges 50 and 52 with an arcuate shape approximating that of the containers 12 to facilitate gripping thereof. Actuators 54 and 56 are attached by brackets 58 and 60 to the platform and are coupled with support plates 46 and 48 to move the plates between an activated position (FIG. 4) with the leading edges 50 and 52 overlaying the opening 28 and a released position (FIG. 5) with the leading edges retracted from the opening. Connectors 62 and 64 lead to a controlling mechanism which operates the plates 46 and 48 in unison.

The second pair of support plates 46 and 48 are coupled with a pair of thrusting fingers 66 and 68 which operate to impart a downward force to a lowermost container 70 during dispensing operations. The thrusting fingers 66 and 68 extend through a central opening in the associated plate and cutout portions 72 and 74 in the platform 26 are provided to accommodate the fingers. Suitable linkages 76 couple plate brackets 78 to both thrusting fingers 66 and 68. Linkages 76 have slots 75 and 77 which receive pins 82 and 84, respectively. The position of the pins within the slots will be adjusted as the actuators 54 and 56 operate. The brackets 78 interconnect actuators 54 and 56 with integral flanges 79 on the plates 46 and 48 so that movement of the plates also results in movement of the thrusting fingers. As is best illustrated in FIGS. 4 and 5, the thrusting fingers 66 and 68 pivot between a released position (FIG. 4) in which they extend through platform cutouts 72 and 74 but do not obstruct the opening 28 and an activated position (FIG. 5) in which they move downward through the opening to impart a downward force to lowermost container 70.

The respective planes in which support plate pairs 30 and 32 and 46 and 48 lie are spaced apart a distance approximately equal to the distance between outwardly rolled rims 80 of adjacent containers 12 in the nested stack 14. Plate actuators 54 and 56 are aligned along a common longitudinal axis, resulting in support plates 46 and 48 being positioned in facing relationship 180 degrees apart along the platform opening 28. The first pair of support plates 30 and 32 are likewise positioned in facing relationship with the longitudinal axis of the associated actuators 38 and 40 being rotated 90 degrees from that of actuators 54 and 56.

In operation, dispenser 10 is loaded with a stack 14 of nested containers 12. When initially loaded, the lowermost container 70 extends through the platform opening 28 with the lower surface of the container rim 80 being supported by the upper surface of the upper or first support plates 30 and 32. In this support position, the plates 30 and 32 support the entire container stack 14. The plates 30 and 32 are then retracted to a released position in which the lowermost container 70 is no longer supported by the plates. The released container stack then moves downward an incremental distance until the rim 80 of the lowermost container 70 engages the top surface of the lower or second pair of support plates 46 and 48. The incremental advancement of the container stack 14 is approximately equal to the distance between adjacent container rims 80 due to the spacing between the plane of the first pair of plates 30 and 32 and the plane of the second pair of plates 46 and 48.

After the container stack 14 has advanced so that the rim undersurface of the lowermost container rests on plates 46 and 48, the upper support plates 30 and 32 are returned to their support position by activation of actuators 38 and 40. The upper support plates are positioned slightly below or in contacting relationship with the rim undersurface of the container adjacent to the lowermost container 70. The container stack is thus positioned as illustrated in FIG. 4 with the lowermost container supported by the lower plates and ready for dispensing while the upper plates are positioned for supporting the remainder of the container stack.

When dispensing of the lowermost container is desired, the lower plates 46 and 48 are retracted to a released position by actuators 54 and 56 to release the container 70. However, because of friction and vacuum forces, the container does not fall free of the container stack 14 at a consistent time when released. In addition, when falling under the influence of gravity, the container is aerodynamically unstable and tends to tumble during the free fall. To overcome these problems, the thrusting fingers 66 and 68 exert a positive downward force on the container upon release from the support plates 46 and 48.

As illustrated in FIG. 5, thrusting fingers 66 and 68 are activated upon retraction of lower plates 46 and 48 and pivot downwardly to engage the upper surface of the container rim 80 and exert a thrusting force thereto. The fingers are linked to plates 46 and 48 in a manner such that the thrusting force is preferably applied only after the plates 46 and 48 have retracted far enough to release the container. This positive release of the container moves it downwardly faster than when under the influence of gravity alone, thereby reducing the tendency for the container to tumble. The stability of the container during its fall is also aided by a cleaner release from the stack 14. In this regard, it is important that the thrusting fingers fingers 66 and 68 exert equal downward forces on the container. In addition, the fall of the container is more precisely and consistently timed by the action of the thrusting fingers.

After the lowermost container 70 has been dispensed, the lower plates 46 and 48 and thrusting fingers 66 and 68 are cycled to their initial positions shown in FIG. 4 in preparation for advancement of the container stack and dispensing of the next container. When the support plates 46 and 48 are returned to their supporting position and the thrusting fingers 66 and 68 have cleared the platform opening 28, the upper support plates 30 and 32 are retracted to release the container stack 14. The advancing container stack then contacts the closed lower support plates in the manner previously described and the dispensing cycle is repeated.

Also encompassed within the present invention is the method of supporting the nested container stack while providing for dispensing of individual containers in a precise and consistently timed fashion so that they are accurately delivered to the receptacles 16 in the carrier plate 18 for delivery to fill station 20. The containers 12 are dispensed in the manner described above so that they arrive in the awaiting receptacle 16 at the appropriate moment. The carrier plate travels with either a continuous or intermittent motion to transport the containers to the fill station 20 where a food or other type of product is introduced into the container. The carrier plate then transports the filled containers to the seal station 22 where the lid 24 is applied to seal the container.

At high processing speeds, it is critical that the dispensed containers be delivered to the awaiting receptacle 16 with precise timing. Many conventional dispensers employ elaborate mechanical drive systems to actuate and time the dispensing process. Even with such actuating systems, many conventional dispensers are only capable of operating at fewer than sixty cycles per minute and frequently fail to accurately deliver the dispensed containers to the transport receptacle. The dispenser of the present invention, however, has achieved speeds in excess of one hundred cycles per minute while accurate and precisely delivering the dispensed containers to an awaiting receptacle in the carrier plate. It can thus be seen that the present invention provides rapid and reliable delivery of containers one at a time from a nested container stack without the problems associated with prior art devices.

From the foregoing, it will be seen that this invention is one well adapted to attain all of the ends and objects hereinabove set forth together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A dispensing mechanism for supporting a nested container stack and repetitive dispensing of one container at a time from the stack, said mechanism comprising:

a frame;

an upper support plate positioned on the frame for supporting the container stack when loaded thereon, said upper support plate being movable between a support position and a released portion permitting downward movement of said container stack;

a lower support plate spaced from said upper support plate and positioned on said frame for engaging a lowermost container in the container stack and supporting the stack when said upper support plate is moved to the released position, said lower support plate being movable to a released position permitting release of said lowermost container from the lower support plate;

at least one thrusting finger for engaging said lowermost container when released from the lower support plate and imparting a downward force thereto;

linkage means operatively connecting said thrusting finger to said lower support plate for activating and causing movement of said at least one thrusting finger in direct response to movement of said lower support plate; and means for cooperating operating of said upper and lower support plates, and therefore said thrusting finger, whereby said containers are dispensed one at a time from said container stack.

2. The invention of claim 1, wherein said operating means is operative for sequentially moving said upper support plate to the released position while the lower support plate is in the engaged position, then moving the upper support plate back to the engaged position supporting a portion of the container stack while the lower support plate is moved to the released position and the thrusting finger is thereby activated to dispense the lowermost container.

3. The invention of claim 2, wherein said upper and lower support plates are relatively positioned to permit incremental advancement of the container stack, whereby upon movement of the upper support plate to the released position a container supported by the upper plate descends to engage the lower support plate and an adjacent container in the stack is then supported by the upper plate when it returns to the support position.

4. The invention of claim 3, including an opening in said frame for permitting passage of said container stack, wherein said upper and lower support plates are positioned adjacent said opening whereby operation of said plates by said means controls passage of said container stack through said opening.

5. The invention of claim 4, wherein said thrusting finger is activated by said operating means when said lower support plate reaches said released position.

6. The invention of claim 4, including a second upper support plate operatively paired with said first mentioned upper support plate and a second lower support plate operatively paired with said first mentioned lower support plate.

7. The invention of claim 6, wherein said at least one thrusting finger comprises a pair of said thrusting fingers, each cooperatively associated with a respective one of said lower support plates.

8. A container dispensing, transport and filling apparatus for dispensing containers individually from a nested container stack, transporting the dispensed containers to a location, and filling the transported containers with food or other type of product at said location, said apparatus comprising:

a product fill device for delivering a product into the containers;

a transport mechanism for conveying containers to the product fill device; and a container dispenser positioned for dispensing the containers from the nested container stack onto the transport mechanism, said dispenser comprising a frame, paired first support plates positioned on the frame for supporting the container stack when loaded thereon engaging a portion of a container in the stack, said first support plates being movable to a released position permitting release of said container from the first support plates and downward movement of sad container stack, paired second support plates spaced from said first support plates and positioned on said frame for engaging said container and supporting the container stack when said container moves downward after release from said first support plates, said second support plates being movable to a released position permitting release of said container from the second support plates, at least one thrusting finger for engaging said container released from the second support plates and imparting a downward force thereto;

linkage means operatively connecting said thrusting finger to one of said lower support plates for activating and causing movement of said at least one thrusting finger in direct response to movement of said lower support plate, and means for cooperative operating of said paired first and second support plates, and therefore said thrusting finger, whereby said containers are dispensed one at a time from said container stack onto the transport mechanism.

9. The invention of claim 8, wherein said operating means is operative for sequentially moving said first support plates to the released position while the second support plates are in the engaged position, then moving the first support plates back to the engaged position supporting the container stack while the second support plates are moved to the released position and the thrusting finger is thereby activated to dispense the container.

10. The invention of claim 9, wherein said first and second support plates are relatively positioned such that the container released upon movement of the first support plates to the first position descends to engage the second support plates.

11. The invention of claim 10, including an opening in said frame for permitting passage of said container stack, wherein said first and second support plates are positioned adjacent said opening whereby operation of said plates by said operating means controls passage of said container stack through said opening.

12. The invention of claim 9, wherein said thrusting finger is activated by said operating means when said second support plates reach said released position.

13. The invention of claim 12, wherein said at least one thrusting finger comprises a pair of said thrusting fingers, each cooperatively associated with a respective one of said lower support plates.

14. The invention of claim 12, including means for applying a lid to said containers when filled with the product.

15. A process for supporting a nested container stack and dispensing individual containers from the stack, said processing comprising the steps of:

(a) supporting a lowermost container in the nested container stack on a lower support plate which is movable between support and released positions;

(b) supporting the remainder of the nested container stack on an upper support plate which is movable between support and released positions;

(c) moving the lower support plate to the released position to release the lowermost container, thereby activating a thrusting finger (d) returning the lower support plate to the support position;

(e) moving the upper support plate to exert a downward force on the released container and thus dispense the released container to the released position to permit downward indexing of the container stack and then returning the upper support plate to the support position when the lowermost container remaining in the container stack descends into engagement with the lower supper plate; and (f) then repeating steps (a) through (e) to dispense additional containers from the nested container stack.

16. The process as set forth in claim 15, including the step of dispensing of the released lowermost container in timed relation to a moving transport receiving the dispensed container.

17. The process as set forth in claim 15, wherein the step of supporting the lowermost container on the lower plate comprises the step of supporting a bottom surface of an out-turned rim of the container on the lower plate.

18. The process as set forth in claim 17, wherein the step of activating the thrusting finger to exert a downward force on the released container comprises the step of applying a downward force on an upper surface of the out-turned rim of the container.

19. The process as set forth in claim 18, wherein the steps of activating the thrusting finger comprise the steps of moving the thrusting finger from a recessed position to a activated position and then back to the recessed position, wherein the downward force is applied to the container as the thrusting finger moves from the recessed to activated position.

20. The process as set forth in claim 15, including the steps of receiving the dispensed container in a holding receptacle and then transporting the container in the holding receptacle to a station for filling the container with a product.

21. The process as set forth in claim 20, including the steps of filling the container with a product and then sealing the container.

* * * * *